US009445202B1

(12) United States Patent
Chyzhov

(10) Patent No.: US 9,445,202 B1
(45) Date of Patent: Sep. 13, 2016

(54) ELECTROACOUSTIC TRANSDUCER HAVING CONTROLLED ION GENERATION

(71) Applicant: AGA Ad Media, LLP, London (GB)

(72) Inventor: Maksym Viktorovich Chyzhov, Odessa (UA)

(73) Assignee: AGA ad Media, LLP, London (GB)

( * ) Notice: Subject to any disclaimer, the term of this patent is extended or adjusted under 35 U.S.C. 154(b) by 0 days.

(21) Appl. No.: 14/986,391

(22) Filed: Dec. 31, 2015

(51) Int. Cl.
*H04R 23/00* (2006.01)

(52) U.S. Cl.
CPC ..... *H04R 23/004* (2013.01)

(58) Field of Classification Search
None
See application file for complete search history.

(56) References Cited

U.S. PATENT DOCUMENTS

| | | | | |
|---|---|---|---|---|
| 1,533,730 | A | 4/1925 | Engler | |
| 1,605,295 | A | 11/1926 | Shrader | |
| 1,687,011 | A | 10/1928 | Fleischmann | |
| 1,758,993 | A | 5/1930 | Wolff | |
| 3,476,887 | A | 11/1969 | Seligson et al. | |
| 4,204,244 | A * | 5/1980 | Ho | G01L 9/0075 361/275.2 |
| 4,460,809 | A | 7/1984 | Bondar | |
| 8,085,957 | B2 | 12/2011 | Shishov et al. | |
| 2009/0022340 | A1 | 1/2009 | Krichtafovich et al. | |
| 2015/0117692 | A1 | 4/2015 | Akino | |

FOREIGN PATENT DOCUMENTS

| | | | |
|---|---|---|---|
| UA | 105621 | C2 | 5/2014 |

* cited by examiner

*Primary Examiner* — Jesse Elbin
*Assistant Examiner* — Kenny Truong
(74) *Attorney, Agent, or Firm* — Finnegan, Henderson, Farabow, Garrett & Dunner LLP

(57) ABSTRACT

The present disclosure relates to the field of acoustics, sound reproduction technologies, and the design principle of the loudspeaker, and more particularly, to an electroacoustic transducer having controlled ion generation. The electroacoustic transducer may include an anode having one or more discharge elements electronically connected to a first terminal of a voltage source, the one or more discharge elements of the anode having a first surface area configured to generate ions in conjunction with the connected voltage source. The electroacoustic transducer may also include a cathode having one or more discharge elements electronically connected to a second terminal of the voltage source, the one or more discharge elements of the cathode having a second surface area configured to generate ions in conjunction with the connected voltage source, wherein a ratio of the first surface area to the second surface area is greater than one.

19 Claims, 12 Drawing Sheets

ELECTROACOUSTIC TRANSDUCER HAVING CONTROLLED ION GENERATION

TECHNICAL FIELD

The present disclosure relates to the field of acoustics, sound reproduction technologies, and the design principle of the loudspeaker, and more particularly, to an electroacoustic transducer having controlled ion generation.

BACKGROUND

Loudspeakers, hereinafter referred to as electroacoustic transducers, are devices that convert electrical energy into energy acoustic oscillations. Electroacoustic transducers are utilized in many consumer products, such as household stereo systems, home theater systems, audio systems for automobiles, portable music devices, headphones, recording studio equipment, acoustic sensory equipment, and others. Demand for high quality sound production and/or recording from these and other products has generated great interest in the development of electroacoustic transducers that can convert electronic signals into sound waves with greater accuracy and higher definition.

One problem with known electroacoustic transducers is their reliance on moving components (e.g., voice coils and diaphragms) to produce acoustic oscillations in a two-step energy conversion process. In the first step, electric energy of a sound signal is converted into mechanical vibrations of a membrane attached to the electro acoustic transducer. In the second step, the mechanical vibrations of the membrane create acoustic oscillations in a surrounding gas medium (e.g., air). The membrane has a certain mass, an ultimate rigidity and given boundaries, which affect the quality of sound reproduced in the surrounding space during the second step. Thus, the quality of sound reproduction is physically limited by these aspects of the membrane. Some manufacturers have sought to overcome these challenges by producing different types of electroacoustic transducers that operate without the use of moving parts. For example, electroacoustic devices have been developed that create sound waves using areal electric discharge. However, known electroacoustic transducers employing areal electrical discharge may not perform optimally.

One example of an electroacoustic transducer that operates with ionized gas particles instead of a moving diaphragm is disclosed in U.S. Patent Application Publication No. 20090022340 A1 (the '340 publication) of Krichtafovich et al. The '340 publication discloses ion generation at one electrode, which is active due to the presence of discharge elements with a large surface curvature. Generated ions drift to the second electrode, which is passive due to the lack of discharge elements with a large surface curvature. In the drift process, a so-called ion wind is created, which is a macroscopic air flow. This flow also generates acoustic vibrations during modulation. However, the dipole radiation pattern, i.e., the generation of two opposing waves, requires the use of acoustic processing preventing an acoustic short circuit. This design may not allow for the achievement of high operational stability and may result in the occurrence of hissing, crackling, and arcing or spark discharge due to the asymmetry of the unipolar corona discharge process, particularly when the power output is increased. Ionization of surrounding gas molecules may serve as a conductor for ions of the same sign, which may prohibit self-stabilization of the process. As a result, the electrical discharge distributed in space in the form of moving ions may be allowed to "collapse" and change to a spark or arc discharge, resulting in audible hissing or crackling sounds.

Another example of an electroacoustic transducer that operates with ionized gas particles instead of a moving diaphragm is disclosed in U.S. Pat. No. 4,460,809 (the '809 patent) to Bondar. The '809 patent describes an electroacoustic transducer comprising rows of electrodes separated by sheets of dielectric material. Each adjacent row or electrodes is connected to an opposite pole of a voltage source. This design achieves a so-called bipolar corona discharge, whereby the corona discharge process involves two types of charged particles, i.e., cations and anions. However, during the ion drift process, the ions are allowed travel freely along a bended path around dielectric sheets from one electrode to another. As a result of the uninhibited movement of ions between adjacent electrodes, the system of the '809 patent may not provide conditions for a self-stabilization process to be realized. That is, the system of the '809 patent may allow an electrical discharge of moving ions distributed in space to "collapse" and change to a spark or arc discharge.

Another example of an electroacoustic transducer is disclosed in Ukrainian Patent No. 105,621 C2 to Chizhov et al. ("the '621 patent"). The electroacoustic transducer of the '621 patent includes a cathode and an anode having discharge elements that are arranged in a row and linearly spaced apart by not more than 4 mm. The discharge elements extend into a space between the cathode and anode (i.e., an "interelectrode space") and are three-dimensional bodies with a large surface curvature. An electrical circuit connecting the anode and cathode to a voltage source includes current-limiting elements. The configuration of the electroacoustic transducer of the '621 patent may increase the uniformity of the electric field in the interelectrode space, thereby stabilizing the corona discharge and preventing the generated cations and anions from collapsing their spatial electric discharge into a spark or arc.

While the electroacoustic transducer of the '621 patent may be effective, further improvements to the generation and control of ionized gas particles in the operation of electroacoustic transducers may yet be realized to achieve improved sound quality at higher power levels.

The disclosed electroacoustic transducer is directed to overcoming one or more of the problems set forth above and/or other problems of the prior art.

SUMMARY OF THE INVENTION

In one aspect, the present disclosure is directed to an electroacoustic transducer. The electroacoustic transducer may include an anode having one or more discharge elements electrically connected to a first pole of a voltage source, and a cathode having one or more discharge elements electrically connected to a second pole of the voltage source. The discharge elements have an active region, which is manifested in the glow of the gas surrounding it when a sufficient electrical potential difference is applied between the cathode and anode, and provide the generation of cations and anions. The active region is characterized by an area on the surface of each discharge element that is exposed to surrounding gas and directly participates in ion generation when a voltage is applied to the electrodes. The shape, size and location of the discharge elements are selected such that the area of the active region of the anode is greater than the area of the active regions of the cathode discharge elements.

In another aspect, each of the one or more discharge elements of the anode and the cathode may have a cross-sectional length not greater than 3 mm.

In another aspect, each of the one or more discharge elements groups of discharge elements may be separated from an adjacent element or group of discharge elements by means of dielectric barrier. The dielectric barrier may have a shape and a size needed for effective spatial separation of the discharge process occurring at each discharge element or group of discharge elements, and prevent the occurrence of a breakdown in the redistribution of potentials in current-limiting elements connecting the one or more discharge elements or groups of discharge elements to the voltage source.

BRIEF DESCRIPTION OF THE DRAWINGS

The accompanying drawings, which constitute a part of this specification, illustrate several embodiments and, together with the description, serve to explain the disclosed principles.

DETAILED DESCRIPTION

Figure 1:
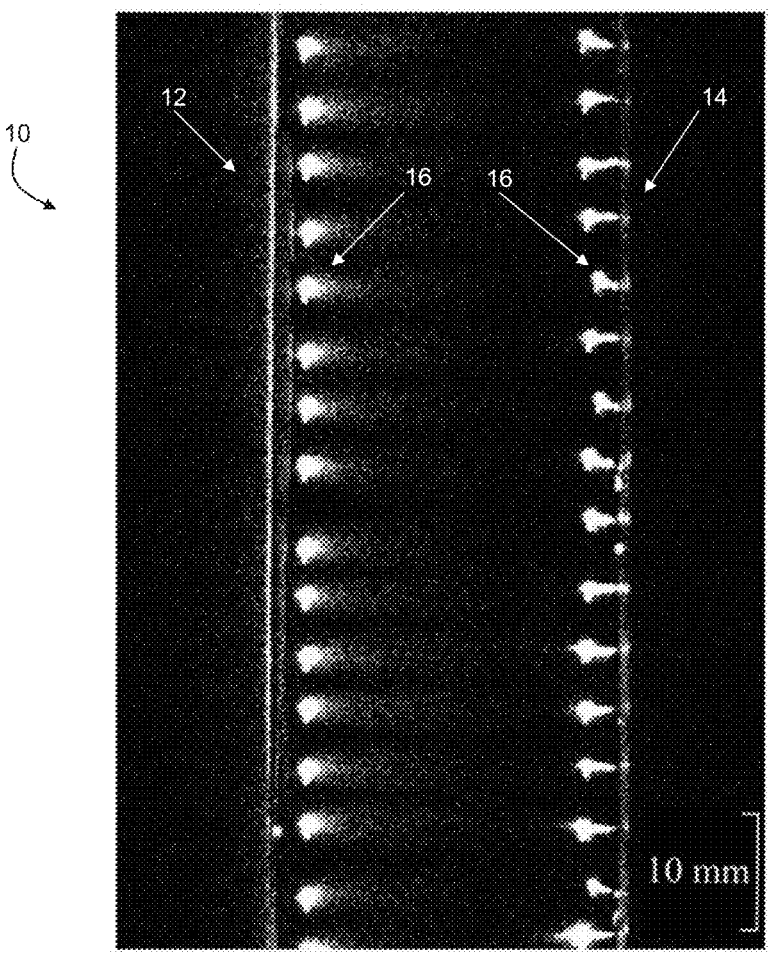
FIG. 1 (PRIOR ART)
FIG. 1 is a photographic image of a bipolar coronal discharge between an anode and a cathode of a known electroacoustic transducer.

FIG. 1 shows a prior art electroacoustic transducer 10 having a cathode 12 and an anode 14. The cathode 12 and the anode 14 each include a row of discharge elements 16 extending into the space between the anode 14 and the cathode 12. Each discharge element 16 is surrounded by an area of weak radiance associated with a discharge process that occurs when a voltage is applied between the anode 14 and the cathode 12. The distance between adjacent discharge elements 16 of at least one of the electrodes (i.e., the cathode 12 and/or the anode 14) is not more than 4 mm. The distance between electrodes is limited because increasing this distance spatially separates the discharge process occurring at each discharge element, which can adversely affect the stability of the bipolar corona discharge, as well as the acoustic properties of the electroacoustic transducer (i.e., the quality of sound produced may be reduced).

The anode 14 and cathode 12 of the electroacoustic transducer 10 of FIG. 1 have a large surface curvature, which creates a high field intensity near the discharge elements 16 when energized. When the electroacoustic transducer 10 of FIG. 1 is energized (i.e., when a voltage potential is applied to the electrodes), an active region forms on each discharge element of the cathode and the anode. As used herein, the term "active region" refers to an area (e.g., a surface area) of each discharge element that directly participates in ion generation. An area that directly participates in ion generation, i.e., the active region, may be identified as a surface area that is surrounded by a glow of ionized gas when the electroacoustic transducer is energized (i.e., when a voltage potential is applied to the anode 24 and cathode 22 by the voltage source). When the electroacoustic transducer is energized, the active region forms on a surface area of each discharge element. This surface area of each discharge element on which the active region may form is referred to herein as a "discharge element area." When the electroacoustic transducer is not energized, the discharge element area may be identified as a portion of a discharge element that protrudes from an electrode.

In the electroacoustic transducer of FIG. 1, the size of the area of the active region of the discharge elements on the anode and cathode depends on the applied voltage, which can have adverse effects on the quality of sound produced. That is, due to an excessive amount of discharge element area available for participation in the ionization process, the active region of each discharge element can increase to include more of the available discharge element area when the applied voltage is increased (and can decrease when the applied voltage is decreased). Thus, when a potential difference is applied to the electrodes (i.e., anode 14 and cathode 12) and a dynamic voltage (i.e. a modulation signal, such as an electric audio frequency signal) is applied, the size of the active surface area of the discharge elements 16 can be modulated in response to changes in the dynamic voltage. However, this modulation does not produce linear changes in the size of the active region with respect to changes in the dynamic voltage signal. Rather, the size of the active region varies non-linearly (e.g., described by a transfer function) with the frequency and amplitude of the dynamic voltage signal during modulation, thereby diminishing the quality of the emitted sound wave.

Figure 2:
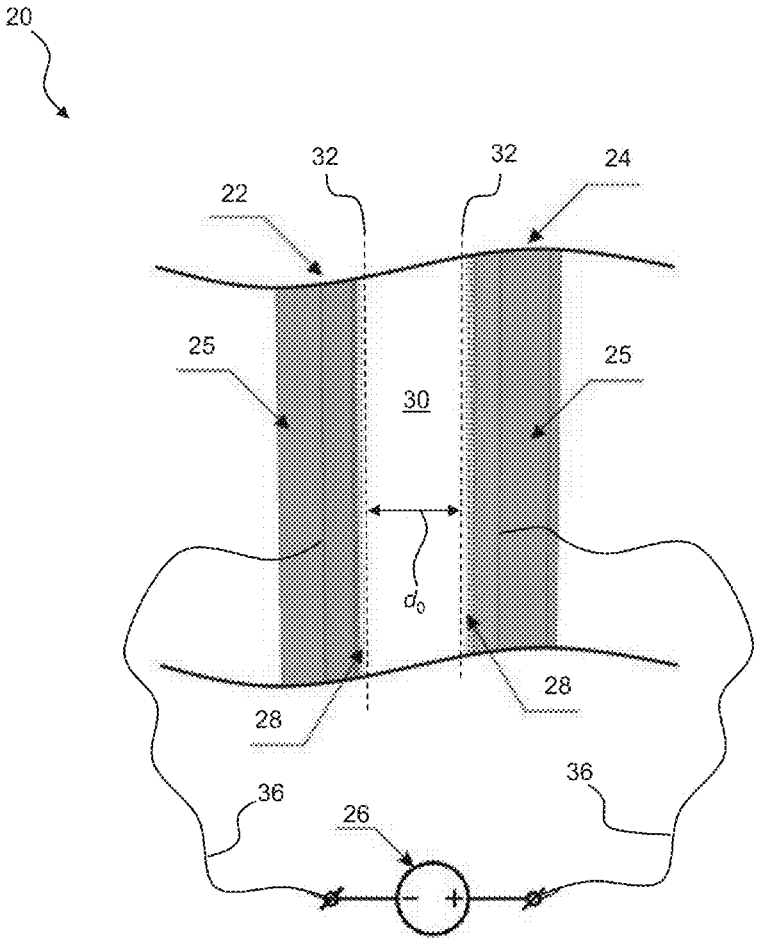
FIG. 2 is a pictorial illustrations of an exemplary disclosed electroacoustic transducer.

FIG. 2 shows an exemplary electroacoustic transducer 20 consistent with the present disclosure and configured to overcome the deficiencies of known electroacoustic transducers. The electroacoustic transducer 20 of FIG. 2 may include one or more electrodes, including a cathode 22 and an anode 24 supported by structural elements 25. The cathode 22 and anode 24 may each be a solid conductive body (e.g., a unitary body) or a set of one or more electrically connected conductors. The cathode 22 and the anode 24 may each be electrically connected to opposite poles of a voltage source 26 (e.g., an AC voltage source, a DC voltage source, etc.). The cathode 22 and the anode 24 may each also include a surface having one or more discharge elements 28 extending into a gap 30 between the cathode 22 and the anode 24. That is, each discharge element 28 may have a first end connected to one of the electrodes and a second end or terminal extending toward the other electrode into the gap 30.

The voltage source 26 may be any electrical device configured to generate and maintain sufficient voltage for a bipolar coronal discharge to occur. The voltage source 26 may include or be used in conjunction with voltage modulation componentry configured to modulate the power of the coronal discharge in response to a modulation signal. For example, voltage modulation componentry may include vacuum tubes, transistors, key elements, transformers, and combinations thereof. Modulation componentry may be used in amplification, transformation, or modulation modes, and may include devices, such as tube amplifiers, semiconductor amplifiers, step-up voltage transformers, modulated voltage sources, and/or other devices.

Discharge elements 28 may comprise a conductive material, such as copper, aluminum, steel, another conductive material, or combinations thereof. In some embodiments, discharge elements 28 may each be formed of the conductive material during a suitable manufacturing process, such as forging, casting, extruding, additive manufacturing (e.g., 3-D printing), machining, or any other suitable process. In other embodiments, discharge elements 28 may be formed of a suitable material coated with the conductive material. Discharge elements 28 may also or alternatively comprise chemically inert or corrosion-resistant materials, such as chrome, stainless-steel, etc., precious metals (e.g., gold, platinum, silver, palladium, etc.), intermetalloids, alloys, and/or other materials.

In some embodiments, discharge elements 28 may comprise materials having a relatively high or relatively low work function to allow greater ion generation. For example, discharge elements 28 may comprise materials having a work function no greater than 4.5 eV. However, it is understood that discharge elements may comprise materials having a higher or lower work function.

The discharge elements 28 of the cathode 22 and the anode 24 may be arranged in a row along the surface of the respective electrode. In some embodiments, the terminals of discharge elements 28 may extend to a virtual surface 32 between the cathode 22 and the anode 24. A distance $d_0$ between each virtual surface 32 may be equidistant along each row of discharge elements 28. In other words, each of the discharge elements 28 of the cathode 22 may be equidistant from the opposing discharge elements 28 of the anode 24. The actual distance $d_0$ between the cathode 22 and the anode 24 may be selected based on one or more design factors, such as the composition density of the gap 30 between the cathode 22 and the anode 24, the shape and size of the cathode 22 and anode 24, and the range of operating frequencies of input signals supplied to the electrodes. For instance, in one example, when the gap 30 contains air under normal conditions, the distance $d_0$ may be about 10-40 mm. In some embodiments, the discharge elements 28 of electroacoustic transducer 20 may deviate from the virtual surface by not more than a threshold distance. For example, the terminals of discharge elements 28 may be located a distance not greater than 2 mm from the virtual surface 32 in either direction (e.g., nearer or farther) from the virtual surface 32.

In some embodiments, the discharge elements 28 may be a row of discrete elements. That is, each electrode may include a plurality of delineated discharge elements 28. For example, a plurality of delineated discharge elements 28 may include a number of discrete points, needles, blades, serrations, or another type of protruding or elongate feature. Discrete discharge elements 28 may also include portions or elements of dispersed wire mesh or corrugated sheets or films. Discharge elements 28 in a row (i.e., discharge elements 28 of a respective electrode) may be arranged equidistantly relative to adjacent discharge elements 28. In some embodiments, discharge elements 28 may be arranged equidistantly from one another along a geometric reference, such as a virtual surface 32. To improve control of ion generation during the corona discharge process, discrete discharge elements 28 may be spaced apart by no more than a particular threshold. For example, discrete discharge elements 28 may be spaced apart by no more than ⅙ of an inter-electrode distance (e.g., the distance $d_0$ between electrodes). It is understood that other spacing thresholds may be tested and used.

In other embodiments, the discharge elements 28 may be a continuous and/or solid geometric body (e.g., a unitary element) that spans a length of the respective electrode. For example, unitary elements may include wires, blades, conductive strips, or other types of continuous bodies. In some embodiments, one electrode (e.g. cathode 22 or anode 24) may have discrete discharge elements 28 while the other (e.g., the other of cathode 22 and anode 24) has a continuous discharge element 28.

Figure 3:
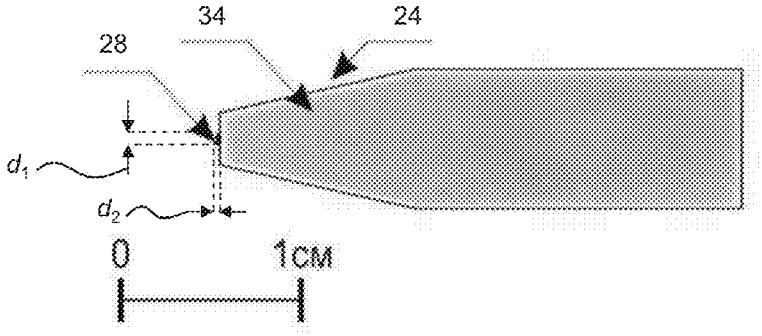
FIG. 3 is a top view illustration of an exemplary disclosed discharge element that may be used with the electroacoustic transducer of FIG. 2.
Figure 4:
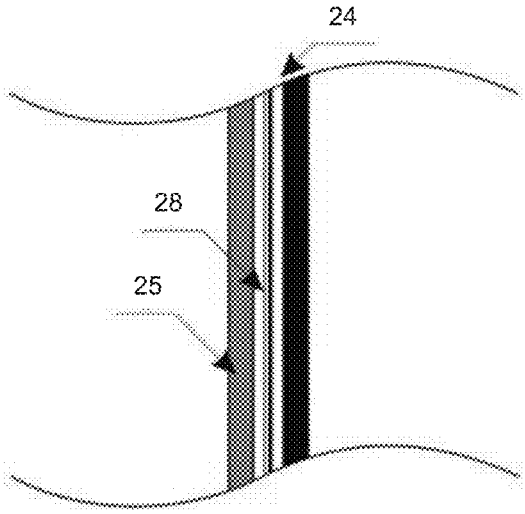
FIG. 4 is a front view illustration of an exemplary disclosed discharge that may be used with the electroacoustic transducer of FIG. 2.

Referring to FIGS. 3 and 4, discharge element 28 may extend outwardly from an electrode, such as anode 24. The electrodes may be coated with a dielectric 34 to allow the voltage potential between cathode 22 and anode 24 to be increased without arc or spark discharge occurring. Dielectric 34 may include any suitable dielectric material, such as glass, ceramics, plastics, rubbers, other materials, and/or combinations thereof. In some embodiments, dielectric materials having relatively higher heat resistant properties may be implemented to improve the longevity of the electroacoustic transducer 20. Any conductor not covered by dielectric 34, including non-active surface areas of discharge elements 28, may parasitically influence the discharge process in an uncontrolled fashion. When such influences remain uncontrolled, fluctuations in current flow may be produced, which can cause audible crackling and hissing and/or arc or spark breakdown of the corona discharge.

Each discharge element 28 may have a cross-sectional length not greater than a threshold length in order limit the size of the active surface area of the discharge elements 28 and control the ion generation thereon. For example, each discharge element 28 may have one or more of a first cross-sectional length $d_1$ and a second cross-sectional length $d_2$. It is understood that discharge elements 28 having different configurations may have different or other cross-sectional lengths. In some embodiments, cross-sectional lengths $d_1$ and $d_2$ of discharge elements 28 may be less than or equal to 3 mm. It is understood that other cross-sectional lengths may be used.

Figure 5:
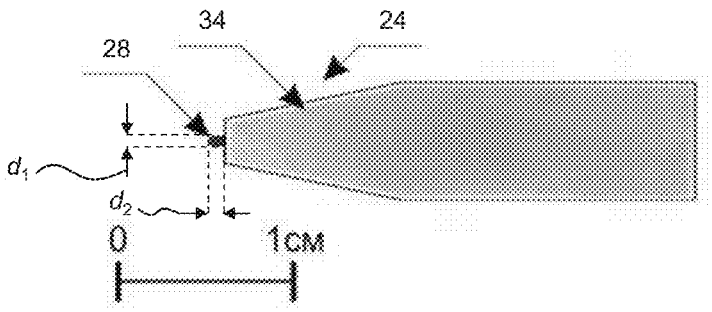
FIG. 5 is a top view illustration of an exemplary disclosed discharge element having a cross-sectional length less than 3 mm.
Figure 6:
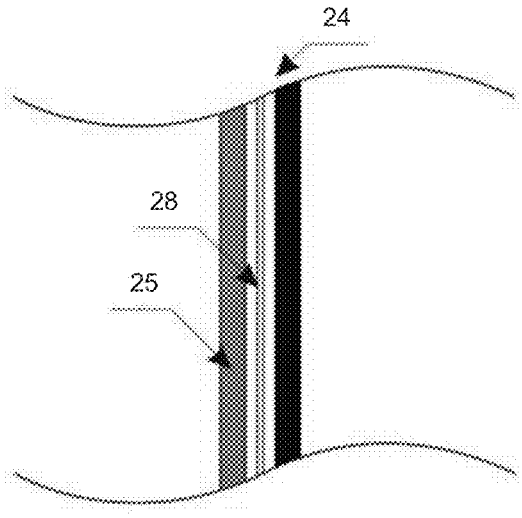
FIG. 6 is a front view illustration of an exemplary disclosed discharge element having a cross-sectional length less than 3 mm.

Referring to FIGS. 5 and 6, when one or more of the cross-sectional lengths $d_1$ and $d_2$ of discharge elements 28 exceed the threshold, the active surface area of discharge elements 28 may be too great to allow high-power sound generation without unfavorable sound effects caused by arcing or sparking. That is, as the size (i.e., the discharge element area) of discharge elements 28 increases, the intensity and uniformity of ionization can be reduced, which can lead to the production of distorted sound, white noise, arc or spark discharge, etc. In some instances, when the size of discharge elements 28 increases beyond a threshold, no sound may be produced. For example, when one or more of the cross-sectional lengths $d_1$ and $d_2$ is greater than 3 mm, the intensity and/or uniformity of ion generation may be so reduced as to result in no sound generation. The threshold cross-sectional length may vary depending on the spacing between each adjacent discharge element, the composition of space between electrodes (e.g., type of gas, density of gas, humidity, solid particles, liquid particles, etc.), and the voltage difference between the electrodes.

To further limit the surface area of the discharge elements 28 (i.e., the discharge element area), thereby limiting the size of the active region of each discharge element when energized, the electroacoustic transducer 20 may be configured to exhibit a ratio of the surface area (San) of anode 24 to the surface area (Scat) of cathode 22 that is greater than 1 (i.e., San/Scat>1). In other words, the surface area of anode 24 may be greater than the surface area of cathode 22. The respective surface areas of the anode 24 and cathode 22 may be the cumulative surface areas of the one or more discharge elements 28 associated with each respective electrode. In some embodiments, each discharge element 28 of an electrode may be the same size, about the same size, or a different such that undesirable arc or spark discharge (and resulting sound effects and distortions) are avoided.

Limiting the size of the active surface areas of the cathode 22 and anode 24 by maintaining a ratio of San/Scat>1 may allow for the recombination of ions of opposite signs near discharge elements 28 during the coronal discharge process even as the voltage between cathode 22 and anode 24 is modulated. Configuring electroacoustic transducer 20 with a ratio of San/Scat>1 may allow a high acoustic power density to be produced (i.e., high-volume sound production), while preserving the spatial and temporal stability of the coronal discharge (e.g., reduction or elimination of arc and/or spark breakdown and hissing and/or crackling).

For instance, cations are produced by shock ionization in the active region of the discharge elements 28 within the coronal discharge. The intensity of ion generation depends on the intensity of the electric field generated between the electrodes, as well as on the size of the discharge element area that forms the active region of the discharge elements 28. Anions arise as a consequence of the trapping of free electrons emitted by the cathode 22 due to autoelectronic emissions, which occur in the space between the electrodes. In that space, the current emission density may attain a relatively large value (e.g., up to $10^{10}$ A/cm$_2$ in vacuum). Thus, the speed of anion generation is inversely proportional to the area of the discharge element of the cathode 22. When the $S_{an}/S_{cat}$ ratio≤1 and depending on the form and arrangement of the discharge electrodes, the discharge process can be either very weak (i.e., insufficient for proper sound generation) or unstable, as the balance of the generated anions and cations may be disturbed. Such disturbance can cause discharge instability, acoustic distortion, and arc or spark breakdown. When San/Scat>1, these deficiencies may be avoided.

In some embodiments, $S_{an}/S_{cat}$ may be greater than 1. For example electroacoustic transducer 20 may be configured to exhibit 25≥San/Scat>1 (e.g., 20≥San/Scat>1; 15≥San/Scat>1; 10≥San/Scat>1; 9≥San/Scat>1; 8≥San/Scat>1; 7≥San/Scat>1; 6≥San/Scat>1; 5≥San/Scat>1, 4≥San/Scat>1; 3≥San/Scat>1). In some embodiments electroacoustic transducer 20 may be configured to exhibit 20≥San/Scat≥2 (e.g., San/Scat=6). That is, the ratio of San to Scat may be between 2 and 20, inclusive. As used herein, the term "inclusive," when used with reference to ranges of values, is intended to include the endpoint values of the range. It is understood that other San/Scat values may be tested and implemented than those listed above.

Figure 7:
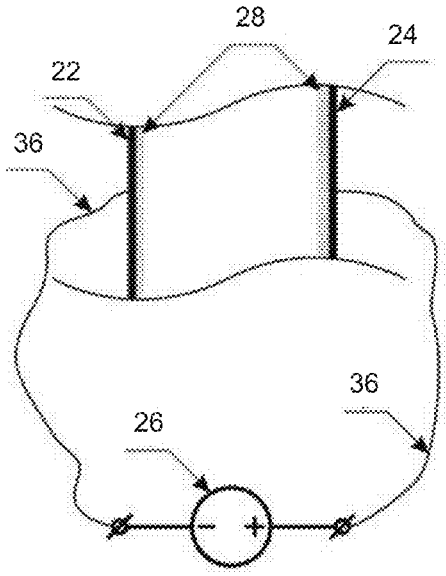
FIGS. 7-10 are schematic illustrations of exemplary disclosed circuits that may be used with the electroacoustic transducer of FIG. 2.
Figure 8:
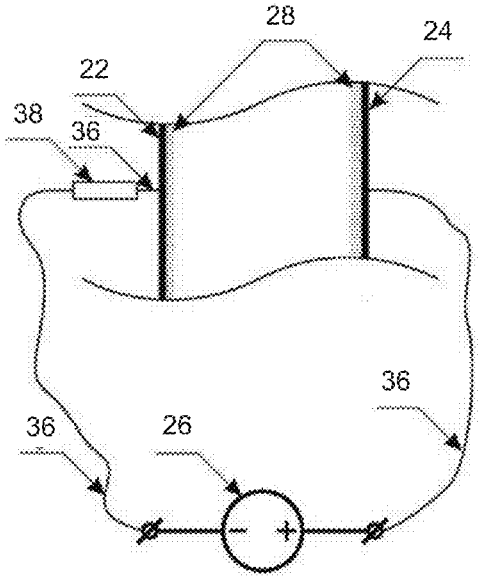
Figure 9:
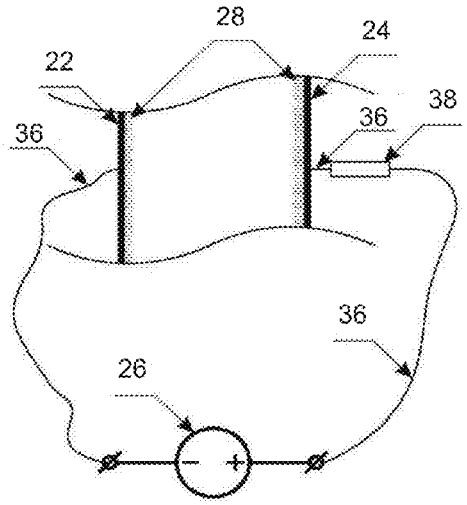

FIG. 7 shows an exemplary circuit configured to connect the cathode 22 and anode 24 of electroacoustic transducer 20 to the voltage source 26 via one or more conductors 36 (e.g., wires). To allow electroacoustic transducer 20 to operate at higher voltages without arc or spark discharge, the electroacoustic transducer 20 may include one or more current-limiting devices to prevent the electrodes from receiving an over-voltage, which can lead to arc or spark generation. For example, FIG. 8 shows an exemplary circuit having a current-limiting element 38 configured to limit the flow of current to cathode 22 in the event of a voltage spike or other type of over-voltage evet. Similarly, FIG. 9 shows an exemplary circuit having a current-limiting element 38 configured to limit the flow of current to anode 24 in the event of a voltage spike or other type of over-voltage evet. In some embodiments, as shown in the exemplary circuit of FIG. 10, multiple current-limiting elements 38 may be configured to separately limit the flow of current to cathode 22 and anode 24 in the event of a voltage spike or other type of over-voltage evet. Current-limiting element 38 may include one or more circuit components configured to limit current flow. For example, current-limiting elements 38 may be resistors.

Figure 11:
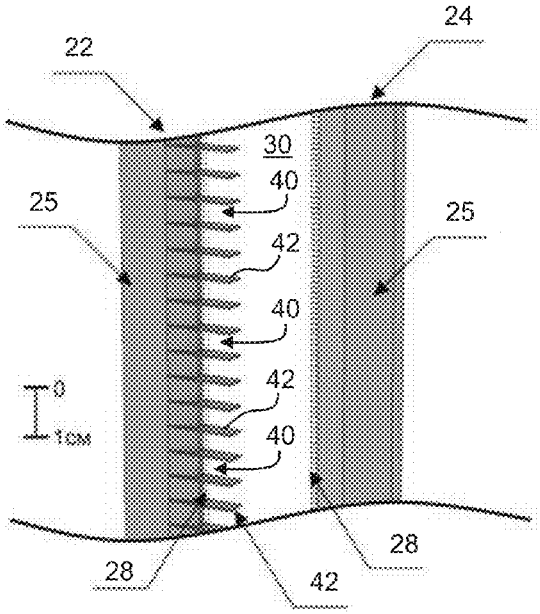
FIG. 11 is a pictorial illustrations of an exemplary disclosed electroacoustic transducer.

In some embodiments, anode 24 and/or cathode 22 may be divided into sections. For example, as shown in FIG. 11, cathode 22 may be divided into sections 40 along its length. Adjacent sections 40 may be separated by dielectric partitions 42 that extend from cathode 22 into the gap 30 between anode 24 and cathode 22. As shows in FIG. 12, each section 40 may be electrically connected to voltage source 26 via conductors 36 and a separate current-limiting element 38.

Figure 13:
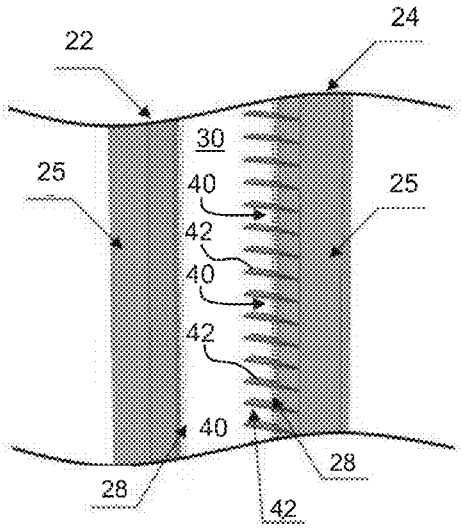
FIG. 13 is a pictorial illustrations of an exemplary disclosed electroacoustic transducer.

In some embodiments, as shown in FIG. 13, anode 24 may be divided into sections 40 along its length. Adjacent sections 40 may be separated by dielectric partitions 42 that extend from anode 24 into the gap 30 between anode 24 and cathode 22. As shows in FIG. 14, each section 40 may be electrically connected to voltage source 26 via conductors 36 and a separate current-limiting element 38.

Figure 15:
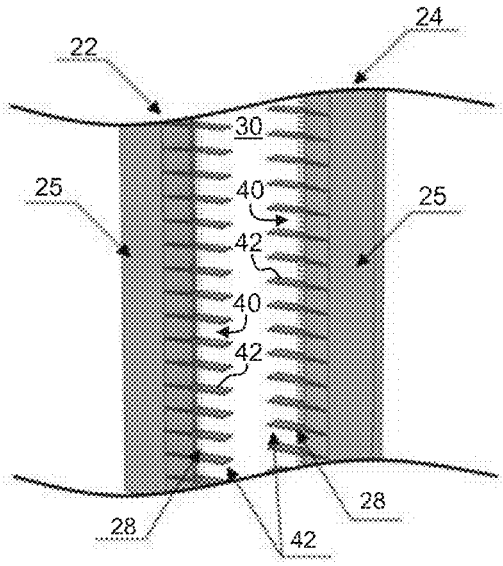
FIG. 15 is a pictorial illustrations of an exemplary disclosed electroacoustic transducer.

In some embodiments, as shown in FIG. 15, cathode 22 and anode 24 may both be divided into sections 40 along their lengths. Adjacent sections 40 may be separated by dielectric partitions 42 that extend from cathode 22 or anode 24 into the gap 30 between anode 24 and cathode 22. As shows in FIG. 16, each section 40 may be electrically connected to voltage source 26 via conductors 36 and a separate current-limiting element 38.

Figure 17:
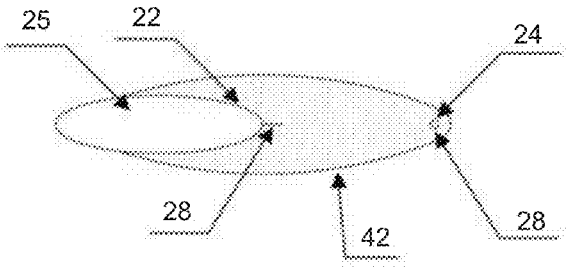
FIG. 17 is a top view illustration of an exemplary disclosed electroacoustic transducer.
Figure 18:
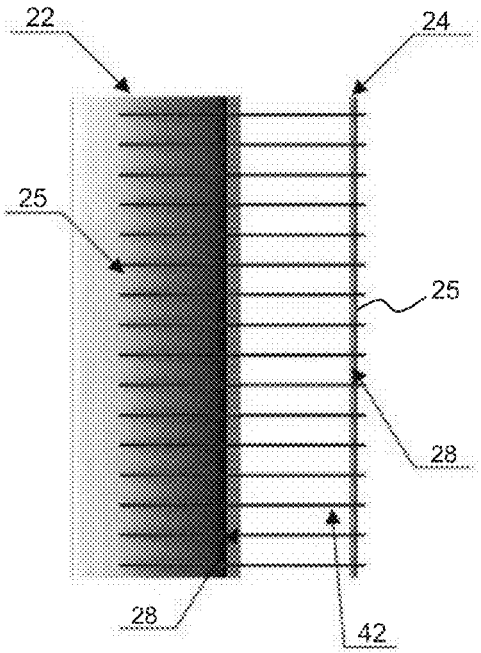
FIG. 18 is a side view illustration of the electroacoustic transducer of FIG. 17.

In some embodiments, as shown in FIGS. 17 and 18, one of the electrodes (e.g., anode 24) may be made from an integral, three-dimensional body with elements of a large surface curvature (e.g., a blade, a narrow plate, a thin wire, etc.) oriented along the array of discharge elements 28 of the anode 24. For example, anode 24 may be a wire, a blade, a plate, etc., that extends along a length of the anode 24. The cathode 22 may be an array of discharge elements 28 that extend toward the anode 24 and into the gap 30 between the cathode 22 and anode 24. The terminals of the cathode 22 may be equidistant from the discharge elements of the anode 24. Dielectric partitions 42 may divide the cathode 22 into sections 40 along its length, and the dielectric partitions 42 may extend from the cathode 22 to the anode 24.

Figure 19:
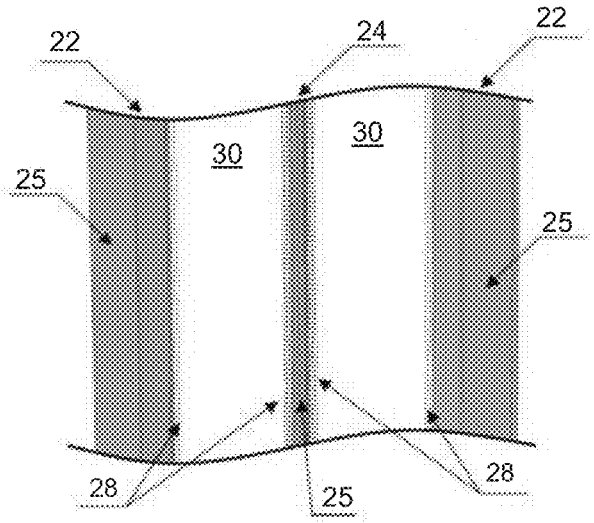
FIG. 19 is an pictorial illustration of an exemplary disclosed electroacoustic transducer having more than one cathode and/or anode.

In some embodiments, as shown in FIG. 19, the electroacoustic transducer 20 may include additional pairs of cathodes 22 and anodes 24. Additional structural elements 25 may be included, which may be positioned between pairs of cathodes 22 and anodes 24. Additional pairs of cathodes 22 and anodes 24 may allow for greater sound generation and may allow for changing the directional pattern of the sound generated according to the audio signal.

Figure 20:
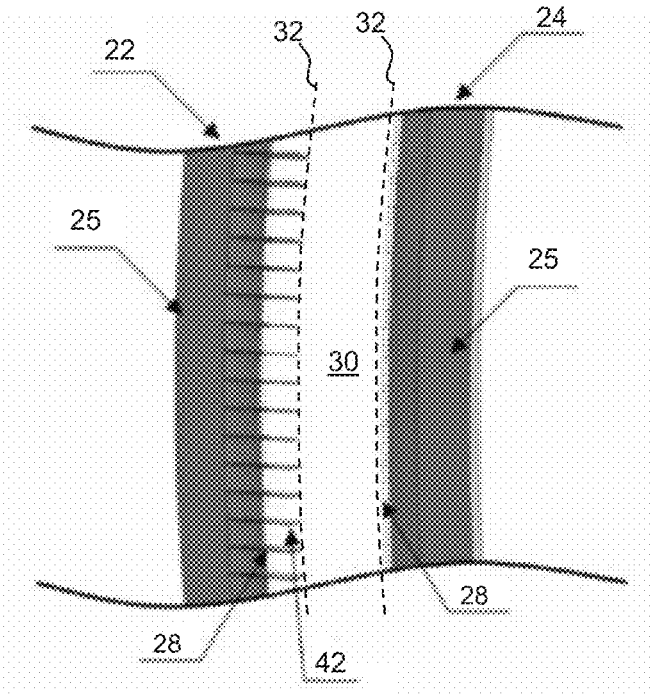
FIG. 20 is a pictorial illustration of an exemplary disclosed electroacoustic transducer having curved electrodes and a virtual curved surface.

In some embodiments, as shown in FIG. 20, the electroacoustic transducer 20 may have curved features. For example, the cathode 22 and the anode 24 may be curved, and their discharge elements 28 may extend equidistantly from one electrode toward the other into the gap 30 between them. In this way, the terminals of the discharge elements 28 of each electrode may extend to a curved virtual surface 32. The curvature of each virtual surface may be the same or different. In some embodiment, the same virtual surface may be shared by both electrodes.

Figure 21:
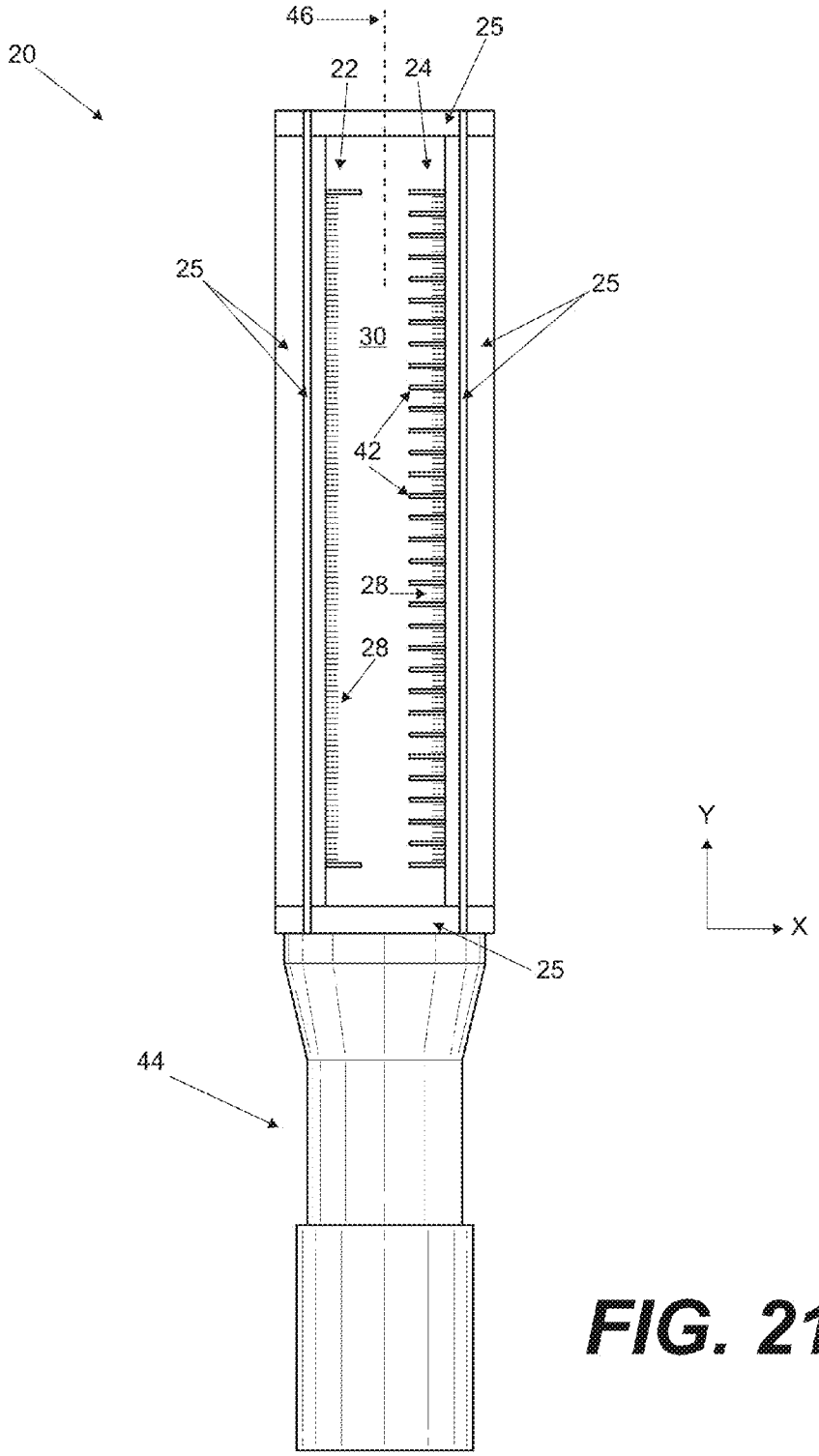
FIG. 21 is a front view illustration of an exemplary disclosed electroacoustic transducer consistent with embodiments of the present disclosure.

FIG. 21 shows an exemplary embodiment of the disclosed electroacoustic transducer 20. As shown in FIG. 21, the electroacoustic transducer 20 may include a base 44 that supports structural elements 25. Base 44 may be formed of any suitable structural material, such as wood, concrete, plaster, resin, plastic, metal, ceramic, etc. In some embodiments, base 44 may house circuitry components, such as conductors 36, current limiting elements 38, and/or other components, such as power supply circuitry (e.g., AC/DC converters, transformers, etc.). In some embodiments, circuitry elements may also or alternatively be entirely or partially housed within structural elements 25. In other embodiments, all power supply circuitry may be external to base 44 and structural element 25.

Cathode 22 and anode 24 may be connected to respective structural elements 25 and spaced apart with gap 30 between them. Discharge elements 28 of cathode 22 and anode 24 may oppose each other and extend into gap 30 from structural elements 25. In the embodiment of FIG. 21, dielectric partitions 42 are spaced along anode 24 and divide the discharge elements 28 of anode 24 into sections. It is noted that in other embodiments, cathode 22 may also or alternatively include dielectric partitions 42. In some embodiments, neither cathode 22 nor anode 24 may include dielectric partitions 42.

Although the embodiment of FIG. 21 shows only one electrode pair (i.e., one cathode 22 and one electrode 24), it is understood that electroacoustic device 20 may include additional electrode pairs. It is further noted that electroacoustic device 20 may be designed to have any desired shape. That is, the form, shape, and construction of structural elements 25 may be designed to have any desired aesthetic appearance. For example, electroacoustic device may be cylindrical, rectangular, triangular, hexagonal, circular, helical, or any other desired shape. Electroacoustic transducer 20 may have any suitable design that allows for the above described features to be implemented successfully.

The disclosed electroacoustic transducer may be applicable to any system where it is desirable to convert electronic signals into sound waves. The disclosed electroacoustic transducer may generate linear and stable corona discharge with increasing the power of an obtained audio signal. The disclosed electroacoustic device may control the amount of generated cations and anions according to a restricted relationship between the active surface areas of the anode and the cathode. The disclosed electroacoustic device may also improve the quality and obtained sound by limiting the size and spacing of discharge elements associated with one or more of the cathode and anode. Spark and arc discharge may also be reduced by the disclosed electroacoustic transducer by anode and cathode connections to a voltage source via one or more current-limiting devices. An exemplary operation of the disclosed electroacoustic transducer will now be explained.

When a negative and positive potential from the voltage source 26 is applied to the cathode 22 and the anode 24, respectively, via the electrical conductors 36, the discharge elements 28 create two streams of negatively and positively charged particles (e.g., ions, charged dust particles, charged steam and/or water droplets) directed toward one another. The voltage potential applied to the electrodes may be sufficient to create stable uniform corona discharge. For example, when used as a loudspeaker, a constant voltage of 7-50 kV and a modulation voltage of 0-50 kV may be applied. It is understood that the voltage at which stable uniform discharge can be achieved may vary depending on the size of the electrodes, the size of gap 30, the composition density of gap 30 and/or other factors. When the streams of charged particles are created in space near each electrode, the charged particles flow along the lines of electric fields created between the electrodes and recombine in the gap 30 between the cathode 22 and anode 24.

Modulation of the voltage between the electrodes results in modulation of the quantity and energy of ions that interact with neutral atoms and molecules of the environment. During signal modulation, signals between, for example, 0-100,000 Hz may be supplied to the electrodes. In some embodiments, audio sound may be generated at about 90 dB or more using input signals of 500 Hz or greater. For signals below 500 Hz, sound generation may depend primarily on the size of the device (e.g., the size of discharge elements 28, the size of gap 30, etc.).

Acoustic wave generated as a result of this modulation may travel in all directions from the ends of the electrodes. Sound waves may be distributed evenly about a central axis 46 that extends along a length of the electrodes (e.g., a vertical axis). Sound waves may also be uniformly generated along the length of electrodes. That is, sound waves may be evenly distributed about axis 46 at each point along the length of the electrodes.

During the corona discharge process, ions are continuously generated and transported in the gap 30. Ions created by corona discharge may travel in gap 30 toward the electrode of opposite charge from itself. Continuous recombination of the ions also results in the generation of heat and excess neutral atoms in the gap 30. As the ions travel to the oppositely charged electrode, they may collide with the neutral atoms and molecules of gas (e.g., air) in the gap 30. Thus, sound waves may be generated by three mechanisms of converting electrical energy into acoustic vibrations: The transfer of kinetic energy between the ions of neutral atoms and gaseous molecules; adiabatic heating of the gas during recombination of cations and anions; and changes in the number of neutral atoms in the interelectrode space due to their continuous generation, drift and recombination in the interelectrode space.

To ensure a high acoustic power density, while preserving the spatial and temporal stability of the coronal discharge, control of the ion generation process, and hence the recombination of ions of opposite signs, is established by limiting the area of the active surface area of the discharge elements 28 of the anode 24 and cathode 22 to a ratio of San/Scat>1. Ion generation is further controlled by limiting the cross-sectional length of the discharge elements 28 to a threshold length, such as 3 mm.

When the electrodes include multiple separate sections 40 (referring to FIGS. 11-16), the sections 40 may be isolated from the adjacent sections 40 by the dielectric partitions 42. The discharge elements 28 may receive voltage signals from voltage source 26 through separate current-limiting elements 38 and conductors 36. In this configuration, the dielectric partitions 42 provide electric insulation, and thereby may prevent unwanted spark or arc discharge from occurring. Separate current-limiting elements 38 for each section 40 of discharge elements 28 may also help reduce or prevent unwanted discharge. For example, current-limiting elements 38 may be resistors of 5-30 MΩ, each being in series between an electrode and the voltage source. In the event of statistically possible fluctuations in the discharge process, mechanical damage to the electrodes, or entry of foreign bodies, liquids, and so forth into the interelectrode space, the conductivity of the interelectrode gap 30 can increase, which can allow spark or arc discharge to occur. To prevent spark or arc discharge, current-limiting elements 38 may be configured to allow a redistribution of a voltage drop between electrodes connected in series and a ballast resistor, such that the occurrence of a spark or arc discharge is immediately extinguished. It is understood that the amount of resistance needed to prevent arc and spark discharge may vary with the amount of voltage supplied and the size of the electroacoustic transducer 20 (e.g., the size of discharge elements 20, the size of gap 30, etc.).

The electroacoustic transducer 20 stabilizes the discharge process by allowing the voltage across the electrodes to be increased, thereby allowing the power of the received audio signal to be increased, while preventing distortion caused by over-voltage, sparking, and arcing. In this way, stable high-quality sound generation may be achieved within a wide range of voltages.

When the discharge elements 28 are spaced along the electrodes at intervals of no more than ⅙ of the inter-electrode distance, the functioning quality of the electroacoustic transducer 20 may be improved. When the discharge elements 28 are configured in this way, uniformity of the discharge process along the rows of discharge elements 28 may be increased, thereby minimizing or fully preventing distortions of the modulation signal.

When the discharge elements 28 of the cathode 22 and the anode 24 are arranged equidistantly along the virtual surface 32, a directional radiation pattern of the sound wave may be produced. In this way, the sound level in a desired spatial region may be controlled.

When current-limiting elements 38 are connected between the electrodes and the voltage source 26, instances of over-voltage across the electrodes may be reduced or eliminated. In this way, sound distortions caused by sparking or arcing associated with over-voltage events may be reduced or prevented, thereby improving the sound quality produced at a wide range of voltages.

When the discharge elements 28 include nano-sized or sub-micron conductive elements, the acoustic power density of the generated sound may be increased. That is, the use of nano-sized or sub-micron conductive elements may allow for a higher autoelectronic current emission, thereby providing higher acoustic power density and greater sound output. The autoelectronic current emission of the electrodes may be further increased when the discharge elements 28 include materials having a relatively small work function (e.g., less than 4.5 eV). Moreover, in order to prevent physical and chemical changes in the discharge elements, which may affect the performance of the discharge process, the discharge elements may be prepared or coated with corrosion-resistant materials, such as gold, platinum, and the like.

When the discharge elements 28 are formed as a continuous conductive body, the corona discharge produced may be more homogenous, thereby improving the uniformity and quality of the ion generation process.

When the discharge elements 28 are separated into sections 40 by dielectric partitions 42 and each section 40 is connected to the voltage source by a separate current-limiting element 38, the voltage across each current-limiting element 38 may be reduced in comparison to embodiments using only one current-limiting element 38 per electrode. This voltage drop may result in a higher operating efficiency of the electroacoustic transducer 20. The voltage across each current-limiting element 38 may be further reduced when the discharge elements 28 of the anode (or sections 40 of the discharge elements 28) are separated by dielectric partitions 42. In this way, the efficiency of the electroacoustic transducer 20 may be further increased. The voltage across each current-limiting element may be further reduced when the discharge elements of the cathode (or sections 40 of the discharge elements) are separated by dielectric partitions 42. In this way, the efficiency of the electroacoustic transducer 20 may be further increased, since the current flowing from the voltage source to the electrode will flow through parallel-connected resistors, thereby reducing the magnitude voltage drop between discharge elements. When the current-limiting element 38 in each case is a resistor, the circuitry design may be simplified and the manufacturing costs of the electroacoustic transducer 20 may be reduced.

When the discharge elements 28 of the cathode extend to the virtual surface 32 and the terminals of the discharge elements 28 are within 2 mm of the virtual surface 32, the manufacturing process of the electroacoustic transducer 20 may be simplified, thereby resulting is a quicker and less costly manufacturing process.

EXAMPLES

Example 1

With reference to FIGS. 2-4, the electroacoustic transducer 20 may consist of two electrodes (e.g., cathode 22 and anode 24) and include discharge elements 28 connected to voltage source 26 via conductors 36. The discharge elements 28 may be arranged in a row, and their terminals may be directed into (i.e., extend into) the gap 30 between cathode 22 and anode 24. The terminals of the discharge elements 28 on each electrode may be equidistant from the terminals of the discharge elements of the opposing electrode. Although depicted in FIG. 2 as discrete elements, the discharge elements 28 may be discrete or continuous bodies having a cross-sectional length not greater than 3 mm. The voltage source 26 may be any electrical device capable of generating and maintaining a sufficient potential difference across the electrodes of the electroacoustic transducer 20 that is sufficient for generating bipolar coronal discharge and modulating the power of the coronal discharge consistent with a modulation signal (e.g., an audio signal). The modulation may be carried out using a suitable device, which may include vacuum tubes, transistors, key elements, transformers and combinations thereof. Such devices may be used in amplification, transformation or modulation modes, and may be include a tube amplifier, a semiconductor amplifier, a step-up voltage transformer, or a modulated voltage source.

Example 2

With reference to FIGS. 5 and 6, a second example consistent with this disclosure may be analogous to Example 1, wherein the active surface areas of the discharge elements 28 of the cathode 22 and anode 24 may be within the ratio of $S_{an}/S_{cat}>1$, while the discharge elements 28 are discrete bodies having a cross-sectional size greater than 3 mm.

The electroacoustic transducer of this second example may not effectively provide sufficiently intense, uniform, or stable ion generation as the excess surface area of the discharge elements 28 may contribute to ion generation in a non-linear fashion in response to the modulation signal. Also, an increase in the transverse size of the discharge elements leads to a decrease of the intensity of the electric field and a decrease in the efficiency of ion generation. This non-linear relationship between ion generation and the modulation signal may unstable ion generation, acoustic distortion, and breakdown of the arc or spark.

Example 3

A third example consistent with this disclosure may be analogous to Example 1, wherein active surface areas of the discharge elements 28 of the cathode 22 and anode 24 may be within the ratio of $S_{an}/S_{cat}\leq 1$, while the discharge elements 28 are discrete bodies having a cross-sectional length less or equal to 3 mm.

The electroacoustic transducer of this second example may not effectively control the generation of cations and anions to be within a ratio that permits successful operation at a wide range of voltages. In this example, when the $S_{an}/S_{cat}$ ratio≤1, the discharge process may be either very weak (i.e., insufficient for proper sound generation) or unstable, as the balance of the generated anions and cations may be disturbed, causing system instability, acoustic distortion, and/or arc or spark breakdown.

Example 4

Figure 10:
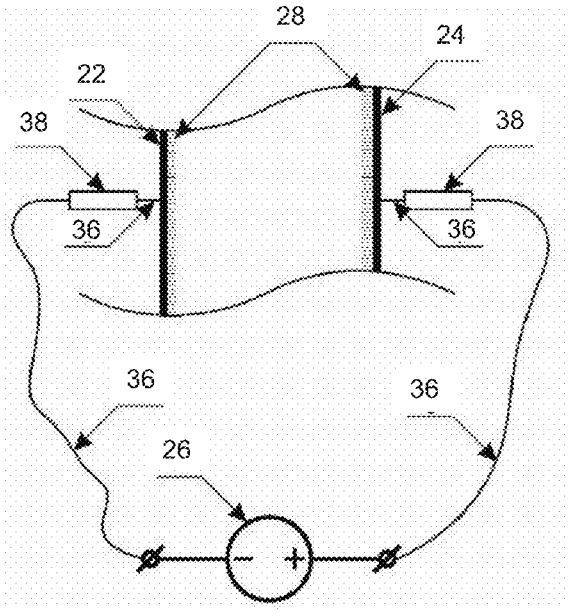

With reference to FIGS. 8-10, a third example consistent with this disclosure may be analogous to Example 1, wherein the current-limiting element 38, for which a resistor may be used, is included in the electric circuit between the voltage source 26 and one or more of cathode 22 and/or anode 24.

The electroacoustic transducer may function analogously to that of Example 1, and may provide protection from the occurrence of arc or spark discharge, thereby allowing the electrode voltage and, thus, the power of audio signal to be increased.

Conversion of the stable, silent, bipolar coronal discharge to an arc or spark discharge, as in the case of overvoltage or a change in environmental conditions, may be reduced or prevented when one or more current-limiting elements 38 are in the circuit. For instance, following the occurrence of an uncontrolled pre-breakdown process, the conductivity of a gaseous medium may increase sharply, and the magnitude of the voltage drop is redistributed across the electrodes and the current-limiting element 38. In this way, over-voltage at the terminals of discharge elements 28 may be prevented and the conversion of coronal discharge to an arc or spark is prevented, thereby protecting stable operations of the system.

Example 5

With reference to FIGS. 11-16, a fifth example consistent with this disclosure may be analogous to that of Example 1, wherein the cathode 22 and/or the anode 24 may be divided into sections 40, comprising groups of linearly arranged discharge elements 28, whereby each section 40 is electrically insulated from the adjacent sections by a dielectric partition 42, and connected to the voltage source 26 through a separate current-limiting element 38, via electrical conductors 36.

The electroacoustic transducer according to this example may operate analogously to that of Example 1 and protect against the occurrence of an arc or spark discharge, while simultaneously increasing the efficiency by reducing the voltage drop in each current-limiting element 38.

Separation of the electrodes into sections 40 with parallel inclusion of the resistors may allow for a decrease in the magnitude of the effective resistance in the electrode circuit, and decreases the magnitude of the voltage drop, thereby increasing the efficiency of the system.

Example 6

Figure 12:
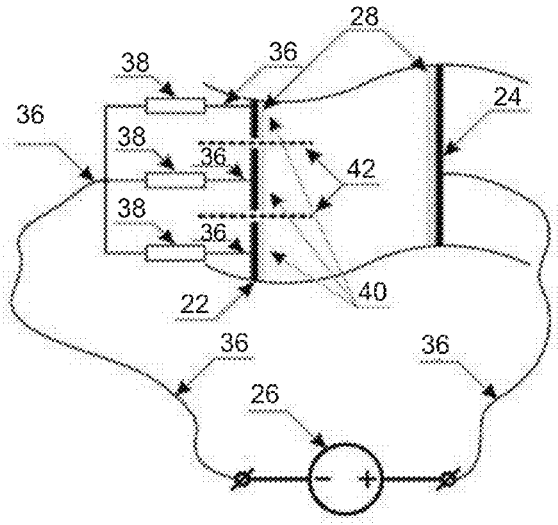
FIG. 12 schematic illustration of an exemplary disclosed circuit that may be used with the electroacoustic transducer of FIG. 11.

With reference to FIGS. 11 and 12, a sixth example consistent with this disclosure may be analogous to Example 1, wherein the cathode 22 may have discharge elements 28 divided into sections of linearly arranged bodies with each section electrically insulated from adjacent sections by a dielectric partition 42 and connected to the voltage source 26 through a separate current-limiting element 38, via electrical conductors 36.

The electroacoustic transducer of this example may operate analogously to Example 1 and protects against the occurrence of an arc or spark discharge, while also improving efficiency by reducing the voltage drop in each current-limiting element 38.

Example 7

Figure 14:
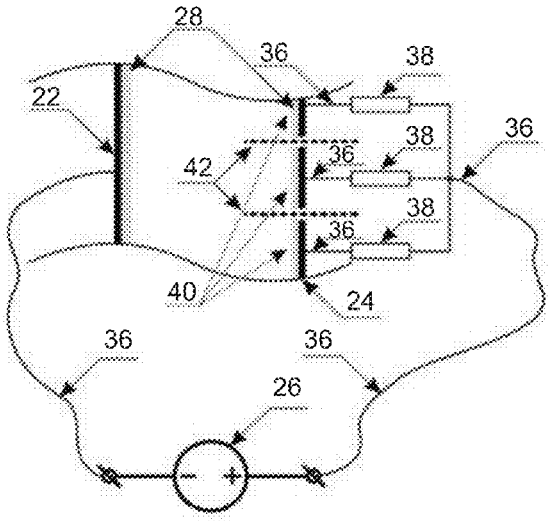
FIG. 14 schematic illustration of an exemplary disclosed circuit that may be used with the electroacoustic transducer of FIG. 13.

With reference to FIGS. 13 and 14, a seventh example consistent with this disclosure may be analogous to Example 1, wherein the anode 24 may have discharge elements 28 divided into sections of linearly arranged bodies with each section electrically insulated from adjacent sections by a dielectric partition 42 and connected to the voltage source 26 through a separate current-limiting element 38, via electrical conductors 36.

The electroacoustic transducer of this example may operate analogously to Example 1 and protects against the occurrence of an arc or spark discharge, while also improving efficiency by reducing the voltage drop in each current-limiting element 38.

Example 8

Figure 16:
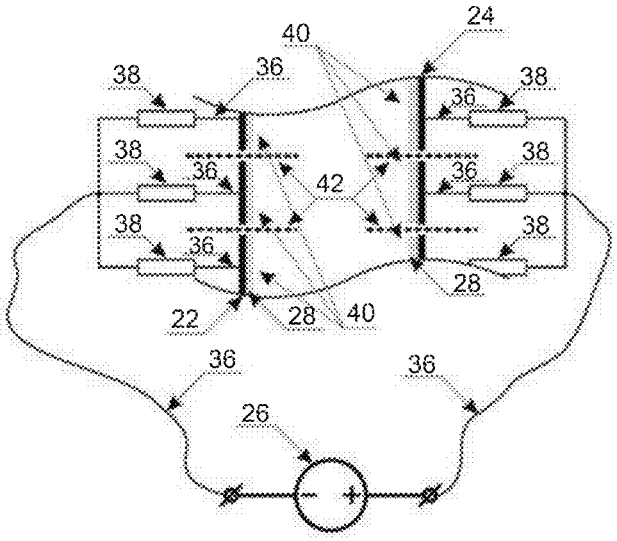
FIG. 16 schematic illustration of an exemplary disclosed circuit that may be used with the electroacoustic transducer of FIG. 15.

With reference to FIGS. 15 and 16, an eighth example consistent with this disclosure may be analogous to Example 1, wherein the cathode 22 and anode 24 may each have discharge elements 28 divided into sections of linearly arranged bodies with each section electrically insulated from adjacent sections by a dielectric partition 42 and connected to the voltage source 26 through a separate current-limiting element 38, via electrical conductors 36.

The electroacoustic transducer of this example may operate analogously to Example 1 and protects against the occurrence of an arc or spark discharge, while also improving efficiency by reducing the voltage drop in each current-limiting element 38

Example 9

A ninth example consistent with this disclosure may be analogous to Example 1, wherein the discharge elements 28 of the cathode 22 may include sub-micron and/or nano-sized elements.

The inclusion of submicron or nano-sized discharge elements 28 may increase the intensity of the electric field near the electrodes, thereby increasing the autoelectronic emission and power density of the electro-acoustic transducer.

Example 10

A tenth example consistent with this disclosure may be analogous to Example 1, wherein the discharge elements 28 of cathode 22 are made of wire mesh with dispersed fibers extending equidistantly into the inter-electrode space with respect to the second electrode.

The electroacoustic transducer of this example may operate analogously to Example 1 and have an alternative design, which expands the technological capabilities for manufacturing the electroacoustic transducer.

Example 11

With reference to FIGS. 3-6, 17, and 18, an eleventh example consistent with this disclosure may be analogously to Example 1, wherein one of the electrodes (e.g., anode 24) is made from an integral, three-dimensional body with elements of a large surface curvature (e.g., a blade, a narrow plate, a thin wire, etc.) oriented along the array of discharge elements 28 of the anode 24, and equidistant from the terminals of the discharge elements 28 of the cathode 22.

The electroacoustic transducer of this example may function analogously to Example 1 and have an alternative design, which expands the technological capabilities for manufacturing the device being claimed.

Example 12

With reference to FIG. 19, a twelfth example consistent with this disclosure may be analogous to Example 1, wherein the electroacoustic transducer includes an additional pair of electrodes (e.g., a cathode 22 and an anode 24).

The electroacoustic transducer of this example may function analogously to Example 1 and provide a general acoustic power system making it possible to change the directional pattern of the audio signal.

Example 13

With reference to FIG. 20, a thirteenth example consistent with this disclosure may be analogous to Example 1, wherein the cathode 22 and anode 24 may be curved. That is, the cathode 22 and anode 24 may be curved and include a shared virtual surface 32 between them.

The electroacoustic transducer of this example may function analogously to Example 1, and may provide emission directivity of the sound while allowing for a desired appearance of the electroacoustic transducer 20.

Several advantages may be realized by the implementation of the disclosed electroacoustic transducer 20. In particular, because the electroacoustic transducer 20 may generate stable corona discharge, sound distortions caused by arcing, sparking, or other unwanted reactions may be significantly reduced or eliminated. Further, because the electroacoustic transducer 20 may generate stable uniform corona discharge over a range of varying voltage inputs, audio signals may be converted into sound waves at volumes that vary linearly with the modulation of the input signal. Additionally, the configuration of the disclosed electroacoustic transducer 20 may allow for the electroacoustic transducer 20 to remain powered up without generating undesired sound effects when in a standby mode or when audio signals are not being supplied to the electrodes. Furthermore, because the disclosed electroacoustic transducer converts audio signals into sound waves by directly ionizing and modulating air or other gas particles without relying on moving parts to transfer kinetic energy, the disclosed electroacoustic transducer may produce sound waves with high accuracy and in high definition (i.e., without or with reduced loss and distortion of sound).

It will be apparent to those skilled in the art that various modifications and variations can be made to the electroacoustic transducer of the present disclosure. Other embodiments of the electroacoustic transducer will be apparent to those skilled in the art from consideration of the specification and practice of the electroacoustic transducer disclosed herein. It is intended that the specification and examples be considered as exemplary only, with a true scope of the disclosure being indicated by the following claims and their equivalents.

What is claimed is:

1. An electroacoustic transducer, comprising:

an anode having one or more discharge elements electronically connected to a first terminal of a voltage source, the one or more discharge elements of the anode having a first surface area configured to generate ions in conjunction with the connected voltage source; and a cathode having one or more discharge elements electronically connected to a second terminal of the voltage source, the one or more discharge elements of the cathode having a second surface area configured to generate ions in conjunction with the connected voltage source, wherein a ratio of the first surface area to the second surface area is greater than one;

wherein the first surface area is a surface area of the one or more discharge elements of the anode that is configured to be surrounded by a glow of ionized gas when a voltage potential is applied to the anode by the voltage source; and the second surface area is a surface area of the one or more discharge elements of the cathode that is configured to be surrounded by a glow of ionized gas when a voltage potential is applied to the cathode by the voltage source.

2. The electroacoustic transducer of claim 1, wherein:

the first surface area is a surface area of the one or more discharge elements of the anode and is configured to directly participate in ion generation when a voltage potential is applied to the anode by the voltage source; and the second surface area is a surface area of the one or more discharge elements of the cathode and is configured to directly participate in ion generation when a voltage potential is applied to the cathode by the voltage source.

3. The electroacoustic transducer of claim 1, wherein the ratio of the first surface area to the second surface area is between 2 and 20, inclusive.

4. The electroacoustic transducer of claim 1, wherein each of the one or more discharge elements of the anode or the cathode extends equidistantly toward the other of the anode and the cathode into the space between the anode and the cathode.

5. The electroacoustic transducer of claim 1, wherein each of the one or more discharge elements of the anode and the cathode has a cross-sectional length not greater than 3 mm.

6. The electroacoustic transducer of claim 1, wherein the one or more discharge elements of the anode or the cathode are spaced apart from adjacent discharge elements by not more than ⅙ of a distance between the anode and the cathode.

7. The electroacoustic transducer of claim 1, wherein the one or more discharge elements of the cathode or the anode are spaced apart from adjacent discharge elements by a uniform distance.

8. The electroacoustic transducer of claim 1, wherein one or more of the cathode and the anode are electronically connected to the voltage source through a current-limiting element.

9. The electroacoustic transducer of claim 1, wherein the one or more discharge elements of the anode or the cathode include sub-micron conductive elements or nano-sized conductive elements.

10. The electroacoustic transducer of claim 1, wherein each of the one or more discharge elements of the anode or the cathode comprises a conductive material having a work function less than 4.5 eV.

11. The electroacoustic transducer of claim 1, wherein the discharge elements or terminals of the discharge elements are made of or coated with a corrosion-resistant material.

12. The electroacoustic transducer of claim 1, wherein the one or more discharge elements of the cathode are divided into a plurality of sections separated by dielectric partitions.

13. The electroacoustic transducer of claim 12, wherein each of the plurality of sections of discharge elements of the cathode is electrically connected to the voltage source by a separate current-limiting element.

14. The electroacoustic transducer of claim 1, wherein the one or more discharge elements of the anode are divided into a plurality of sections separated by dielectric partitions.

15. The electroacoustic transducer of claim 14, wherein each of the plurality of sections of discharge elements of the anode is electronically connected to the voltage source by a separate current-limiting element.

16. The electroacoustic transducer of claim 15, wherein the separate current-limiting element is a resistor.

17. The electroacoustic transducer of claim 1, wherein the one or more discharge elements of the anode or the cathode extend to a virtual smooth surface.

18. The electroacoustic transducer of claim 17, wherein the virtual surface is one of a virtual planar surface and a virtual curved surface.

19. The electroacoustic transducer of claim 18, wherein the terminal of each of the one or more discharge elements of the cathode is not more than 2 mm from the virtual surface.

* * * * *